US008651716B2

(12) United States Patent
Albou et al.

(10) Patent No.: US 8,651,716 B2
(45) Date of Patent: Feb. 18, 2014

(54) LIGHTING MODULE FOR HEADLAMP OF A MOTOR VEHICLE

(75) Inventors: Pierre Albou, Paris (FR); Vanesa Sanchez, Paris (FR)

(73) Assignee: Valeo Vision, Bobigny (FR)

( * ) Notice: Subject to any disclaimer, the term of this patent is extended or adjusted under 35 U.S.C. 154(b) by 113 days.

(21) Appl. No.: 13/117,591

(22) Filed: May 27, 2011

(65) Prior Publication Data

US 2011/0292669 A1 Dec. 1, 2011

(30) Foreign Application Priority Data

May 31, 2010 (FR) ..... 10 02279

(51) Int. Cl.
*F21V 5/00* (2006.01)

(52) U.S. Cl.
USPC ..... 362/520; 362/517; 362/518; 362/507; 362/509; 362/545

(58) Field of Classification Search
USPC ..... 362/516–518, 538
See application file for complete search history.

(56) References Cited

U.S. PATENT DOCUMENTS

| | | | | |
|---|---|---|---|---|
| 7,156,544 | B2 | 1/2007 | Ishida | |
| 7,387,416 | B2 | 6/2008 | Tsukamoto et al. | |
| 7,918,595 | B2 | 4/2011 | Albou | |
| 7,934,861 | B2 | 5/2011 | Albou | |
| 2005/0068787 | A1* | 3/2005 | Ishida | 362/538 |
| 2005/0180153 | A1 | 8/2005 | Albou | |
| 2005/0180154 | A1* | 8/2005 | Albou et al. | 362/514 |
| 2008/0151567 | A1 | 6/2008 | Albou | |
| 2008/0316763 | A1 | 12/2008 | Albou | |

FOREIGN PATENT DOCUMENTS

| | | | |
|---|---|---|---|
| EP | 1564481 | A1 | 8/2005 |
| EP | 1881264 | A1 | 1/2008 |
| EP | 1936260 | A1 | 6/2008 |
| EP | 2009346 | A1 | 12/2008 |
| EP | 2060442 | A2 | 5/2009 |
| EP | 2131098 | A1 | 12/2009 |
| FR | 2860280 | A1 | 4/2005 |

* cited by examiner

*Primary Examiner* — Donald Raleigh
(74) *Attorney, Agent, or Firm* — Jacox, Meckstroth & Jenkins

(57) ABSTRACT

A lighting module having a flat light emitter, a reflector (R1) determined so as to create, in a plane comprising the emitter, a hot spot (S) limited by a control curve (A) contained in the plane comprising the first emitter and constituting the front or rear edge of the spot and a lens (L) determined and arranged with the reflector so as to form the first cutoff beam.

35 Claims, 10 Drawing Sheets

LIGHTING MODULE FOR HEADLAMP OF A MOTOR VEHICLE

CROSS-REFERENCE TO RELATED APPLICATIONS

This application claims priority to French Application No. 1002279 filed May 31, 2010, which application is incorporated herein by reference and made a part hereof.

BACKGROUND OF THE INVENTION

1. Field of the Invention

The invention relates to a lighting module or a lighting unit for a headlamp of a motor vehicle.

2. Description of the Related Art

The lighting modules of the prior art generate a beam making it possible to produce a light beam allowing the road to be lit, doing so alone or in combination with the beam or beams of other modules. They usually comprise an assembly of associated optical elements in order to form the beam. Some of these beams are cutoff beams, notably of the fog lamp or dim type. Certain modules, generating cutoff beams, use imaging lenses and a folding element, that is to say a reflective plate or horizontal reflective mask in order to create the cutoff.

Bifunction lighting modules are also known, notably according to FR 2 860 280, which is equivalent to U.S. Pat. No. 7,156,544, or according to U.S. Pat. No. 7,387,416.

In certain bifunction modules, the folding element is used both for the upper cutoff of the dim beam and for the lower cutoff of the additional beam, making it possible, in association with the dim beam, to produce a high beam. The image of the front edge forms an obscure separation line between the beams given by the two emitters in order to produce the high beam. In order to prevent this dark band, provision has been made to make the common cutoff indistinct by unfocusing the folding element or the lens, or by adding images to the latter. The fusion of the two beams, carried out by virtue of indistinct zones, also leaves a darker zone between the two beams. The modifications attempting to make the cutoff indistinct reduce the value of the maximum intensity of the high beam. These drawbacks are present in the beams produced with the devices of the two patents mentioned above.

SUMMARY OF THE INVENTION

One object of the invention is to produce headlamps of simpler design.

In one embodiment, this invention provides a lighting module for a headlamp of a motor vehicle, suitable for providing, notably according to the instruction that is applied thereto, a first cutoff beam, the lighting module comprising:

a first flat light emitter in order to give the first beam, this emitter being for example formed by at least one photoemissive emitter of a first light-emitting diode or LED;

a lens placed in front of the emitter;

a first reflector;

wherein:

the first reflector is determined so as to create, in a plane comprising the first emitter, a hot spot by diversion of the rays emitted by the first emitter, the hot spot being limited by a control curve forming the front edge or the rear edge of the spot, the curve being contained in the plane comprising the first emitter and situated in front of the first emitter;

the lens is determined such that its section, through a plane orthogonal to the control curve, is identical to that of a stigmatic reference lens between the point of intersection of the control curve with the orthogonal plane, and infinity in the direction given by the intersection of the orthogonal plane and of the plane of the curve, the material of the lens of the module and of the reference lens having the same refraction index, the first reflector and the lens being arranged so as to form the first cutoff beam after refraction by the lens of the rays diverted by the first reflector.

"In front" means in front in the direction of propagation of the light, from the light emitter to the lens.

Such a module makes it possible to create a cutoff beam without the aid of a horizontal or vertical mask. The module thus comprises fewer parts.

Another advantage of such a module is that it can also be associated with another reflector in order to create a bifunction module, being able to generate a cutoff beam, for example a dim or a horizontal cutoff beam, and a second cutoff beam, which, superposed on the first, produces a high beam. Specifically in this case, the absence of a mask, notably a horizontal mask, will make it possible to produce more easily a bifunction lighting module giving a high beam that has no dark band between the superposed beams. This also prevents the presence of mechanisms that are necessary when the mask is movable in order to switch from the high function to the dim function.

According to a preferred embodiment, the first reflector is determined so that the images of the first emitter, that it provides in the plane of this emitter, meet the control curve, while being entirely on the side of the hot spot. This makes it possible to improve the sharpness of the cutoff and to bring the maximum intensity of the first beam toward the cutoff of this first beam.

Preferably, the cutoff beam is a beam with an upper cutoff, the lit zone being situated beneath this cutoff. This is for example the case for a dim beam or fog lamp beam.

A further embodiment of the invention provides a lighting unit for a headlamp of a motor vehicle, suitable for providing, notably according to the instruction that is applied thereto, a light beam, the lighting unit comprising:

a flat light emitter in order to give the first beam;

a lens placed in front of the emitters;

a reflector in order to divert the rays emitted by the light emitter;

wherein:

the reflective surface of the reflector is determined such that, along a reverse path of the light, the light rays parallel to a given direction, after passing through and diversion by the lens and reflection on the reflector, meet the emitter at a given point of the emitter;

the lens is determined such that its section, through a plane orthogonal to a control curve, is identical to that of a stigmatic reference lens between the point of intersection of the control curve with the orthogonal plane, and infinity in the direction given by the intersection of the orthogonal plane and of the plane of the curve, the material of the lens and of the reference lens having the same refraction index, the control curve being situated in front of the emitter, the reflector and lens being arranged so as to form the light beam, after refraction by the lens of the rays diverted by the reflector.

Such a lighting unit corresponds to an alternate embodiment of a light beam.

According to a variant embodiment of the lighting unit, the given point of the emitter is a point of the front or rear edge of the emitter. Thus the beam obtained by this embodiment makes it possible to also create a cutoff beam without the aid of a horizontal or vertical mask.

When this lighting unit is associated with a lighting module according to the invention, the given point of the emitter is a point of the front or rear edge of the emitter depending on whether the control curve constitutes respectively the rear edge or the front edge of the hot spot generated by the first reflector and the first emitter. The beam produced by the lighting unit therefore also has a cutoff.

The given direction may be inclined relative to the plane of the emitter of the lighting unit.

According to a variant embodiment of the lighting unit, the reflector is determined:

by considering that the module comprises a strip of zero thickness, having a front face indistinguishable from its rear face, consisting of a fraction of a cylinder with generatrices orthogonal to the plane of the control curve, the front face accepting this control curve as a cross section;

by considering the front face to be an infinite vertical extent;

so that, along a reverse path of the light, light rays parallel to an arbitrary direction, for example chosen in a plane parallel to the plane of the emitter, after passing through and diversion by the lens, after passing through the front face then the rear face of the strip, and reflection on the reflector, meet the emitter at a point in the vicinity of its center;

this allows an alternate embodiment of the reflector of the lighting unit, notably in order to produce a beam without cutoff; "the vicinity of the center of the emitter" means a point that is closer to its center than to its edges; preferably, the distance to the edge is three times greater than the center distance; again preferably, the distance to the edge is ten times greater than the center distance.

According to a first embodiment of the invention, the lighting module according to the invention may also have, in addition to the main features specified in the above paragraph, one or more of the following additional features, any combination of these additional features, to the extent that they are not mutually exclusive, constituting an advantageous exemplary embodiment of the invention:

the lighting module also comprises a lighting unit according to the invention, the emitter of this lighting unit corresponding to a second emitter of the lighting module according to the invention, the reflector of the lighting unit corresponding to a second reflector of the lighting module, the first reflector and the lens being arranged so as to form the first cutoff beam, and the second reflector and this lens being arranged so as to form a second light beam; the lens is therefore optically associated with the first reflector and with the second reflector; this makes it possible to reduce the bulk by having a single module to produce two light beams; it is thus possible to carry out two lighting functions, for example by lighting the first beam only, for a first function, and by superposing thereon the second beam, for a second function;

the reflective faces of the first reflector and of the second reflector are facing one another; such a module is more compact; preferably the first emitter emits toward the first reflector and the second emitter emits toward the second reflector; preferably, the lighting module comprises a common support for the first emitter and the second emitter, each of the emitters being situated on either side of this support;

the reflective surface of the second reflector is determined so that the second light beam is added to the first cutoff beam in order to thus produce a high beam;

the second beam has a low cutoff, so that the second beam can supplement the first cutoff beam, the low cutoff of the second beam being adjacent or parallel to that of the first cutoff beam, preferably in this case slightly beneath the cutoff of the first beam; as explained above, the production of a cutoff beam without the aid of a mask makes it possible to superpose these beams while minimizing their overlap or while positioning them adjacently, without having a dark band;

the second reflector is situated either above the second emitter when the latter emits upward, or beneath when it emits downward;

the second emitter emits upward and the first emitter emits downward, or the second emitter emits downward and the first emitter emits upward; this makes it possible to improve the compactness of the module widthwise;

the second emitter is offset transversely relative to the first emitter, so that the cutoff beam produced by the first reflector has an optical axis that is different from the optical axis of the beam produced by the second reflector; this makes it possible to bring the emitters closer to one another vertically, without the heat emitted by one of the emitters damaging the other emitter; when the lighting module comprises a common support for the first emitter and the second emitter, each of the emitters being situated on either side of this support, this also makes it possible to reduce the thickness of this support; moreover, such an embodiment is more effective in terms of luminous flux;

the cutoff beam produced by the first reflector has an optical axis that is different from the optical axis of the beam produced by the second reflector; this will make it possible to position the spot, or zone of maximum intensity of one of the beams, by offsetting it laterally relative to the other beam; it is possible for example to improve the performance of the beam resulting from the superposition of the first beam and of the second beam while spreading it relative to its spot;

the lens of the lighting module is also the lens of the lighting unit;

the hot spot is in front of the control curve, which control curve is preferably convex seen from the lens, or rectilinear; this embodiment makes it possible to produce the module with a convex lens;

the first reflector is designed so that, for any point of the reflective surface of the first reflector, a ray resting on the control curve and reflected at this point arrives, after reflection, at the front corner of the emitter, situated on the side opposite to this point relative to the vertical plane passing through the optical axis; in the present application, "ray resting on the control curve" means a ray meeting this curve and contained in the plane perpendicular to the control curve at the point of intersection of the ray in question and this curve; the optical axis is for example, as illustrated in FIG. 4, the axis contained in the plane of the light emitter, passing through the center of the light emitter and substantially perpendicular to the front edge of the light emitter;

for any given point of the reflective surface of the first reflector:

$$d1+d2=K$$

where d1 is the distance between, on the one hand, the corner of the emitter situated on the side opposite to the given point, relative to the vertical plane passing through the optical axis and, on the other hand, the given point;

d2 is the distance between the given point and the control curve along the ray passing through this given point and resting on the control curve;

K is a constant;

the first emitter emits upward, and creates with the first associated reflector a first cutoff beam of which the lit zone is situated beneath its cutoff line, and the module comprises a strip made of transparent material having a top flat face contained in the plane of the first emitter, and a front face consisting of a fraction of a cylinder with generatrices orthogonal to the plane of the control curve, accepting this control curve as a cross section, so that the refracted portion of the rays reaching the top face enter the strip; this variant makes it possible to absorb the interference rays, notably when the light emitter, for example the photoemissive element of an LED, has no clean edges, or when the interference rays are emitted on the side of the emitter, notably the edge of the photoemissive element of the LED;

the rear face of the strip is either parallel with the front face of this strip or corresponds to a surface resulting from a translation of the surface of the front face of this strip; this makes it possible to guide the interference rays to the bottom of the strip;

the refractive index of the material of the strip is greater than $\sqrt{2}$; this improves the guidance of the interference rays in the strip by total reflection;

the top front edge of the strip is indistinguishable from the control curve, and therefore passes through the focal point of the lens in a vertical sectional plane;

the entrance face of the strip is convex in the forward direction and the exit face is parallel to the face, the thickness of the strip being constant;

the second reflector is determined such that, along a reverse path of the light, light rays parallel to a given direction, after passing through and diversion by the lens, after passing through the front face then the rear face of the strip, and reflection on the second reflector, meet the second emitter at a point of its center, the front and rear faces being considered to be of infinite vertical extent; in this case, the cutoff in the second beam is not achieved by the shape of the second reflector but by the top surface of the strip which returns the rays emitted by the second emitter downward, thus playing the role of a reflective horizontal mask, that is to say of a folding element;

the hot spot in the plane of the first emitter is behind the control curve which is concave seen from the lens, or rectilinear;

the first reflector comprises a first portion of reflective surface designed so that, for any point of the first portion of reflective surface of the reflector situated outside the space included between two planes passing through the rear corners of the emitter and parallel to a vertical plane passing through the optical axis, a ray resting on the control curve and reflected at this point arrives, after reflection, at the rear corner of the emitter, situated on the same side as the given point relative to the vertical plane passing through the optical axis; this embodiment is particularly suitable when the first emitter emits downward; preferably, the first reflector comprises a second portion of reflective surface designed so that, for any given point of the second portion of reflective surface situated inside the space included between two planes passing through the rear corners of the emitter and parallel to a vertical plane passing through the optical axis, a ray resting on the control curve and reflected at this point of the second portion of reflective surface, arrives, after reflection, at the point of the rear edge of the emitter situated in the plane which, on the one hand, contains this given point of the second portion of reflective surface, and, on the other hand, is parallel to the vertical plane passing through the optical axis;

the first reflector is situated either above the first emitter when the latter emits upward, or beneath when it emits downward.

A further embodiment of the invention provides a headlamp of a motor vehicle comprising at least one module and/or one lighting unit according to the invention. The headlamp comprises for example a housing enclosed by a transparent closure glass, this module and/or this lighting unit being inside the space enclosed by the housing and the glass.

This headlamp can produce a long-range lighting beam, by means of a lighting unit according to the invention, such as a high beam, and also a cutoff lighting beam, by means of the lighting module according to the invention.

The lighting unit and the module may also be distinct, each having its own lens. These lenses may, according to the invention, be very close and be placed adjacent to one another. This produces a uniform aspect when switched off.

According to a variant embodiment, the lighting unit according to the invention is designed to be arranged in the headlamp of a motor vehicle, suitable for providing a light beam, such that:

the emitter is arranged so as to emit a beam of light rays generally in a transverse direction;

the reflector is arranged to collect all of the beam of rays;

the orthogonal plane is orthogonal to a vertical plane, preferably containing the longitudinal direction; for example the lens extends vertically along its largest direction; it is therefore possible to have an arrangement of a lighting unit with a limited bulk widthwise; preferably the light beam formed is a high beam. limited bulk widthwise; preferably the light beam formed is a high beam.

In the present application, the longitudinal direction corresponds to the direction travelling from the rear to the front of the vehicle, or approximately the general direction of emission of the light beam of the module or of the unit according to the invention. The vertical direction is perpendicular to the longitudinal direction and corresponds to verticality when the unit or the module operates in a vehicle on a horizontal road. The transverse direction corresponds to a direction perpendicular to the longitudinal direction and to the vertical direction.

According to a variant embodiment, the lighting unit according to the invention is designed to be arranged in the headlamp of a motor vehicle, suitable for providing a light beam, such that:

the emitter is arranged so as to emit a beam of light rays generally in a direction that is approximately vertical;

the reflector is arranged to collect all of this beam of rays;

the orthogonal plane is orthogonal to a horizontal plane; for example the lens extends horizontally along its largest direction; it is therefore possible to have an arrangement of a lighting unit with a limited bulk heightwise.

It is also possible to have a single lighting module according to the invention, including the lighting unit. In this case, the lighting module and the lighting unit preferably share the same lens. This achieves gains not only in a uniform appearance when switched off, but also in compactness.

The invention also relates to a motor vehicle containing such a headlamp.

The invention consists, apart from the arrangements explained above, of a certain number of other arrangements that will be dealt with more explicitly below with reference to exemplary embodiments described with reference to the appended drawings, but which are in no way limiting. In these drawings:

BRIEF DESCRIPTION OF THE ACCOMPANYING DRAWINGS

DETAILED DESCRIPTION OF THE PREFERRED EMBODIMENTS

Figure 1:
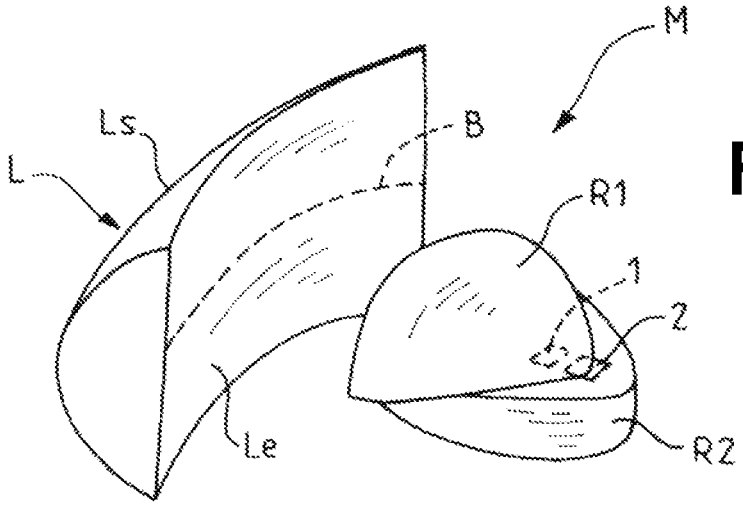
FIG. 1 is a rear three-quarter and from above schematic view in perspective of a lighting module according to the invention, in this example a bifunction module.
Figure 2:
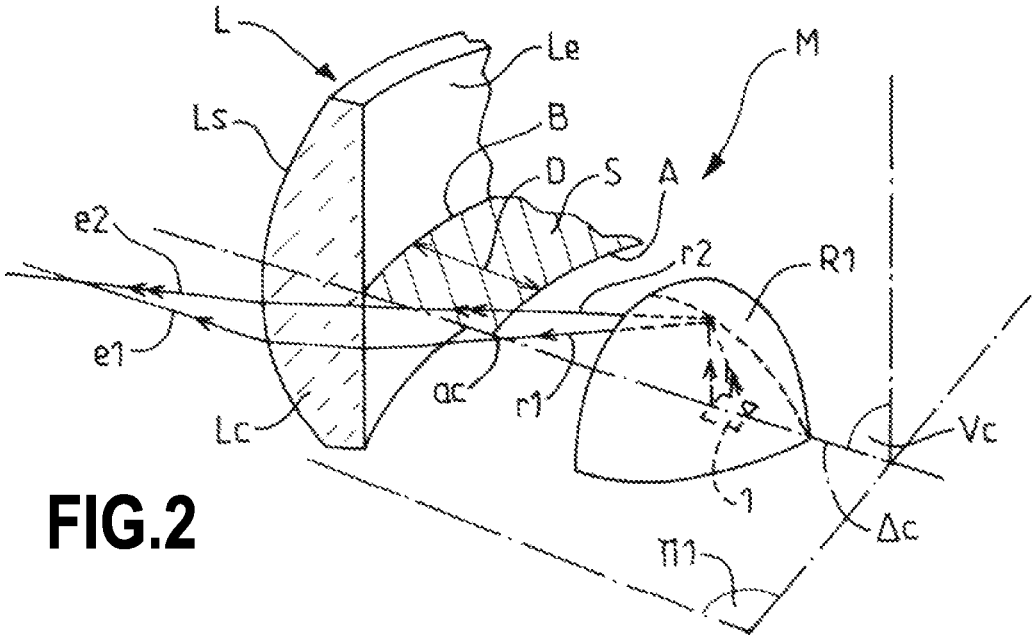
FIG. 2 is a diagram in perspective, with cutaway portions, of the module in section through an orthogonal vertical plane at a point of the control curve, in order to illustrate the construction of the lens.
Figure 3:
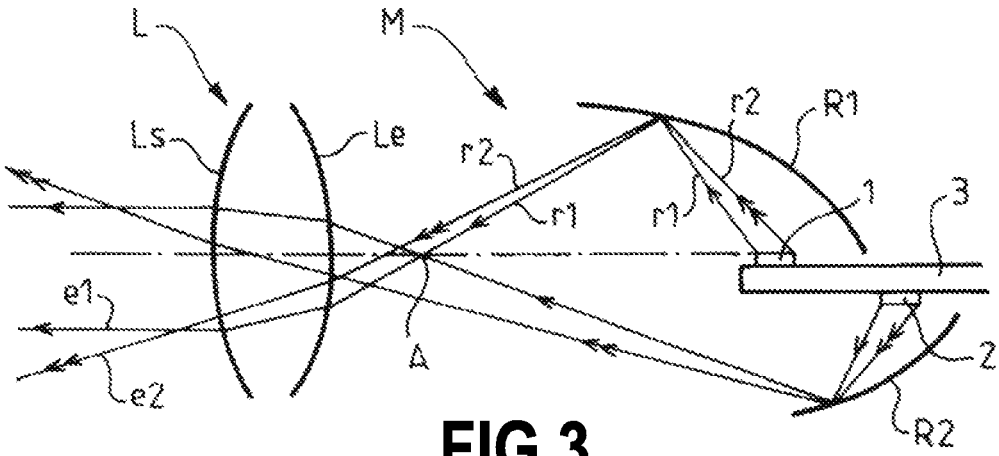
FIG. 3 is a diagram in vertical section of a lighting module similar to that of FIG. 1, with a vertical section of a slightly different lens.

With reference to FIGS. 1-3 of the drawings, it is possible to see a bifunction lighting module M for a headlamp of a motor vehicle comprising a first flat emitter formed by the photoemissive emitter 1 of a first light-emitting diode or LED in order to give a cutoff beam. For example, a foglamp beam is a beam with an upper cutoff which is flat and horizontal. The plane Π1 (FIG. 2) of the LED, namely the plane containing the photoemissive emitter of the LED, is usually horizontal when the module is installed in the vehicle. For example, this plane Π1 may be inclined by 0.57° (1%) below the horizontal, once mounted on the vehicle. It is possible then to take the flat cutoff on the horizontal.

A first reflector R1 is associated with the emitter 1. In the example of FIGS. 1-3, the photoemissive emitter 1 of the first LED emits upward and the first reflector R1 is placed above the first LED. According to the variant of FIGS. 18-19 which will be described below, the photoemissive emitter 1 of the first LED emits downward and the reflector R'1 is placed beneath the LED.

This first reflector R1 is determined so as to create, in the horizontal plane of the first emitter 1, a hot spot S (FIG. 2) limited by a control curve A which can be chosen arbitrarily. The curve A constitutes the rear edge of the spot S, notably when the reflector R1 is above the first emitter 1 as in the case of FIGS. 1-3. As a variant, this curve A may constitute the front edge of the spot S, notably when the first reflector R'1 is beneath the emitter as in the case of FIG. 19.

The curve A, which is not marked out, is contained in the plane Π1 of the emitter 1 and is situated in front of this emitter.

The terms "in front of" and "behind" are to be understood in the direction of propagation of the light that goes from the reflector R1 in the forward direction, that is to say toward the lens.

Figure 4:
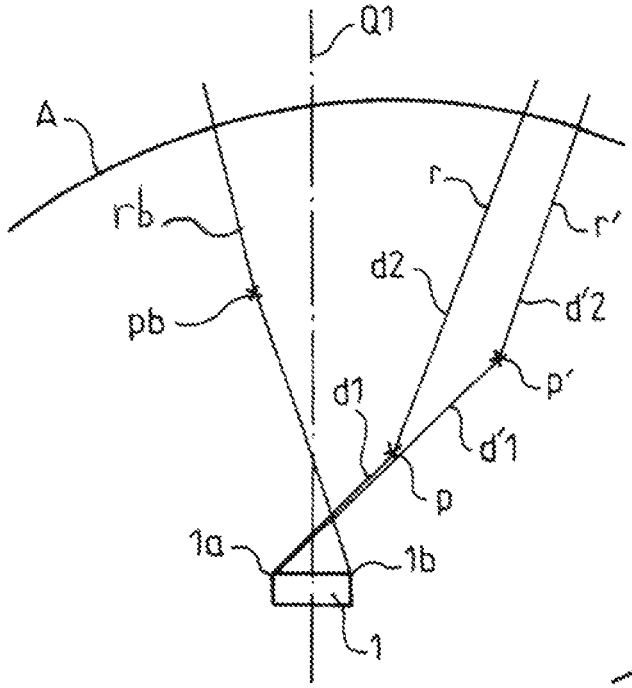
FIG. 4 is a diagram in plan view illustrating the design of the reflector for the dim emitter.

As illustrated in FIG. 4, the reflector R1 for the dim beam is designed considering the reverse path of the light originating from a lens L so that a ray r resting on the control curve A and reflected at a point p of the first reflector R1 reaches the front corner 1*a* of the emitter 1, situated on the side opposite to the point of the entrance face of the lens L, from where the ray in question r comes, relative to the vertical plane Q1 passing through the optical axis. "Ray resting on the curve A" means a ray meeting the curve A and contained in the plane perpendicular to the curve A at the point of intersection of the ray in question and of the curve A. The optical axis is, for example, as illustrated in FIG. 4, the axis contained in the plane of the light emitter and passing through the center of the light emitter and substantially perpendicular to the front edge of the light emitter. The same condition is applied to another point p' of the first reflector R1 which reflects a ray r' also to the corner 1*a*.

The constancy of the optical path is taken into account for the design of the first reflector R1 where, for any given point (p, pb) of the reflective surface of the first reflector (R1):

$$d1+d2=K$$

where d1 is the distance between, on the one hand, the corner (1*a*, 1*b*) of the emitter situated on the side opposite to the given point (p, pb), relative to the vertical plane (Q1) passing through the optical axis and, on the other hand, the given point (p, pb);

d2 is the distance between the given point (p, pb) and the control curve (A) along the ray (r, rb) passing through this given point (p, pb) and resting on the control curve (A);

K is a constant.

For the portion of the curve A situated on the left side of the plane Q1 according to FIG. 4, the rays are reflected at points of the first reflector R1, such as the point pb, in order to reach the front corner 1*b* situated on the opposite side relative to the plane Q1.

The lens L (FIGS. 1-3) is joined with the first reflector R1 and is determined such that its section Lc (FIG. 2) through a plane Vc orthogonal to the control curve A at any point ac is identical to that of a stigmatic reference lens between the point of intersection ac with the plane Vc, and infinity, in the direction given by the intersection Δc of the plane Vc and of the plane Π1 of the curve A.

The reference lens can be easily designed by those skilled in the art by choosing for this reference lens:

a material of the same refractive index as that of the lens L according to the present invention;

a back focal distance D of any value;

any entrance face, for example flat;

a thickness at the center of any value.

The back focal distance D, which corresponds to the distance between the focal point ac of a vertical section of the lens L and the entrance face Le of this lens, is constant, and the section of the entrance face Le through the plane Π1 consists of a curve B parallel to the curve A at the distance D. This back focal distance D, the section of the entrance face Le, and the thickness at the center for this section are identical to those of the reference lens.

In the example shown, the curve A is situated in a horizontal plane which is that of the LED 1. The plane Vc is therefore vertical and orthogonal to the tangent to the curve A at the point ac. The intersection Δc is horizontal and itself orthogonal to the tangent to the curve A at the point ac. A light ray r1 reflected by the first reflector R1 and passing through the point ac exits from the lens L along the ray e1 parallel to Δc. The ray r1 originates from the front edge of the emitter 1. The other light rays of the emitter 1 will originate from a point situated behind that which supplies the ray r1 so that the reflected ray r2 will be above the ray r1 so as to meet the plane Π1 in front of the line A, in the spot S. This ray r2 will exit the lens L along an emergent ray e2 inclined downward relative to the direction Δc and to the horizontal plane Π1.

The lens L makes it possible to spread the beam because of the convex shape of the curve A in the forward direction; the appearance of the lens L is substantially toroidal with a convex exit face Ls.

The beam given by the whole of the first emitter 1, of the first reflector R1 and of the lens L is a beam with horizontal cutoff, the cutoff line being determined by the curve A, which has no material thickness, and the beam is situated beneath the cutoff line since the rays such as e2 are inclined downward relative to the horizontal plane Π1.

Figure 5:
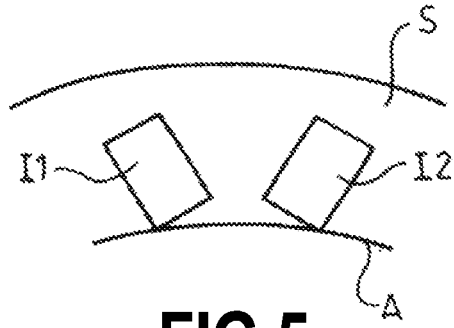
FIG. 5 is a diagram in plan view illustrating images of the dim emitter given by the associated reflector.

As illustrated in FIG. 5, the images such as I1, I2 of the LED 1 given by the various points of the first reflector R1 are situated in front of the curve A. One of the peaks of the rectangular image is in contact with the curve A.

The device thus formed creates a beam with flat cutoff, the horizontal distribution (and notably the width) of which is controlled by the flat control curve A initially chosen. Depending on the configuration in question, the light can be above the cutoff line, the first emitter 1 emitting upward and the control curve A forming the front edge of the hot spot, or first emitter 1 emitting downward and control curve A forming the rear edge of the hot spot, or else beneath the cutoff line, the first emitter 1 emitting upward and the control curve A forming the rear edge of the spot S, or emitter 1 emitting downward and control curve forming the front edge of the hot spot.

Consideration is then given to a second horizontal flat emitter 2 having a direction of emission opposite to that of the first emitter 1 and offset vertically relative to this first emitter 1 in its own direction of emission. This second emitter 2 may also be offset when seen from above relative to the first emitter 1 in order to facilitate the physical installation of the sources, namely closer to or further from the lens L than the first emitter 1.

The second flat emitter 2 is formed by the photoemissive element of a second LED and is designed to contribute to the establishment of a second beam which, in combination with the beam of the first emitter 1, gives a high beam.

In the case of FIGS. 1-3 where the first LED emits upward, the second LED emits downward as illustrated in FIG. 3. The LEDs 1, 2 are placed on the two opposite parallel faces of one and the same support 3, the second LED 2 being situated behind the LED 1.

A second reflector R2 is situated beneath the LED 2 in order to provide the beam which is added to the cutoff beam of the first reflector R1 in order to produce the high beam. The second reflector R2, the emitter 2 and the lens L form a variant lighting unit according to the invention.

An arbitrary horizontal direction is chosen.

It is considered that all the light rays parallel to the chosen direction (FIG. 6) reaching the exit face Ls of the previously designed lens L, and a reflector R2 is determined situated beneath or above the second emitter 2, in its direction of emission, such that the rays in question, after diversion by the lens L and reflection on the second reflector R2, meet the second emitter 2 at a front or rear point of its edge, depending on the configuration of the system. The edge situated on the same side as in the case of the first emitter 1 is used, namely in this example the front edge in the direction of propagation of the light outside the module.

Figure 6:
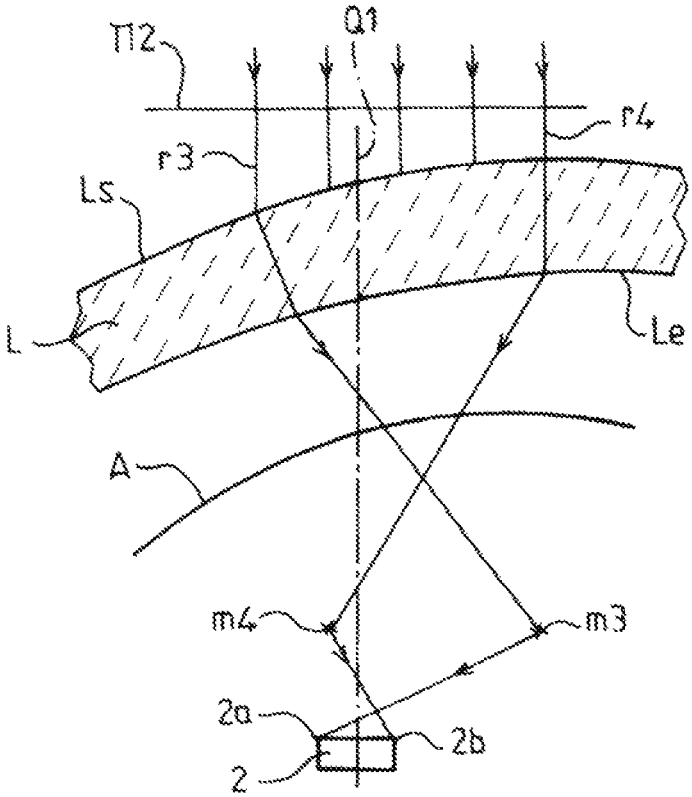
FIG. 6 is a diagram in plan view illustrating the design of the reflector associated with the second emitter for the high beam.

The second reflector R2 is determined as illustrated in FIG. 6 such that, along a reverse path of the light, the light rays r3, r4 parallel to the chosen arbitrary direction in a plane parallel to the parallel planes of the emitters 1, 2, after diversion by the lens L and reflection at a point m3, m4 of the second reflector R2, meet the second emitter 2 at a point 2*a*, 2*b* of its front edge, preferably situated at a corner of the second emitter 2. Still considering the reverse path of the light, the ray last reflected by the point m3 of the reflector R2 reaches the corner 2*a* of the second emitter 2 situated on the side opposite to the point m3 relative to the vertical plane Q1 passing through the optical axis. For the ray r4 which is on the other side of this plane Q1 relative to r3, the ray reflected by m4 originates from the corner 2*b* situated at the other end of the front edge of the second emitter 2.

The plane Π2 orthogonal to the rays r3, r4 is a wave surface for the parallel beam exiting the lens L and originating from the reflector R2. The design of the second reflector R2 is carried out by expressing that the optical path is constant for rays such as r3, r4 between the plane Π2 and the point 2*a*, 2*b* of the second emitter 2 from which the ray originates.

The device thus formed creates a concentrated beam, the light of which is situated on the opposite side (vertically) of the horizontal cutoff of the beam created with the first emitter 1.

The parallel to the control curve A initially chosen, at a distance equal to the total of the back focal distance D of the stigmatic construction lens and of its thickness at the center, has no turn-back point or double point. This parallel corresponds to the cutoff of the exit surface of the lens through the plane Π1 of the emitter 1.

According to a variant embodiment:

if the hot spot in the plane of the first emitter 1 is situated behind the control curve A, the latter must not be convex in the direction of the lens in order to obtain a flat cutoff;

if the hot spot in the plane of the first emitter 1 is situated in front of the control curve A, the latter must not be concave in the direction of the lens.

The properties explained above make it possible to establish the equations of the surfaces of the reflectors R1, R2 and of the lens L, as a function of the control magnitudes: curve, back focal distance, thickness at the center, and refractive index of the material of the stigmatic construction lens, and of two additional arbitrary magnitudes of the optical path type, such as the distance from the bottom of the reflector to the source. The designs are based on considerations of constancy of the optical path between the points of the control curve A and the appropriate points of the edge of the first emitter 1 and, for the second emitter 2, between the appropriate points of its edge and a flat exit wave surface, of previously chosen direction.

Figure 7:
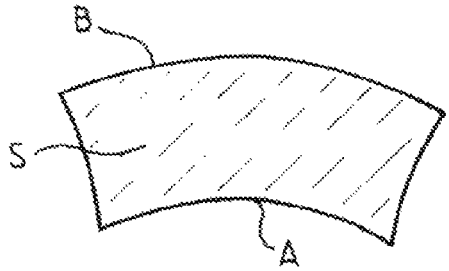
FIG. 7 is an illustration of the hot spot produced by the dim reflector in the horizontal plane of the emitter.

FIG. 7 is an illustration of the hot spot S that is produced in the horizontal plane of the first emitter 1. This hot spot S could be observed after removal of the lens L and the installation of a horizontal screen in the plane of the first emitter 1. The rear limit of the spot S is formed by the curve A, while the front limit B corresponds to the intersection of the entrance face of the lens Le through the horizontal plane of the spot S.

Figure 8:
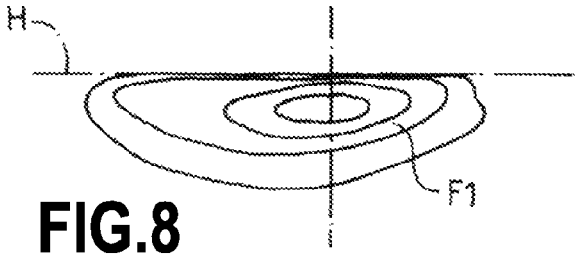
FIG. 8 is a diagram of the isolux curves of the dim beam in a vertical plane orthogonal to the axis of the beam.

FIG. 8 illustrates the isolux curves of the first horizontal cutoff beam obtained with the first LED (first emitter 1), the reflector R1 and the lens L. All of the isolux lines of the beam F1, that is to say its lit zone, are situated under the horizontal cutoff, beneath the horizontal cutoff line H.

Figure 9:
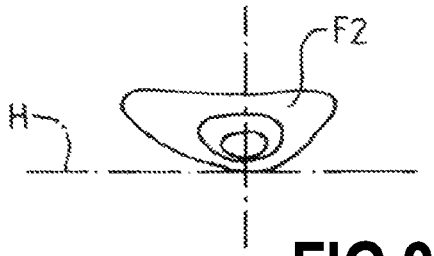
FIG. 9 illustrates the isolux curves of the beam produced by the second emitter for the high beam.

FIG. 9 illustrates the isolux curves of the beam F2 obtained with the second LED 2, the reflector R2 and the lens L, this assembly corresponding to the previously described lighting unit. The isolux curves of the beam F2 are situated above the cutoff line H.

Two possible enhancements are now envisaged. In these two enhancements, the second reflector R2, the emitter 2 and the lens L form variants of the lighting unit according to the invention.

Enhancement 1

For the construction of the second reflector R2 associated with the second emitter 2, a direction of the emergent rays r3, r4 is chosen that is not horizontal and notably inclined upward if the beam created by the first emitter 1 is situated above its cutoff line, or inclined downward if this beam is situated beneath its cutoff line. This arrangement makes it possible to ensure, already for a small angle of inclination, of a few degrees, a good merging of the beams created by the two emitters 1, 2.

Enhancement 2

Figure 10:
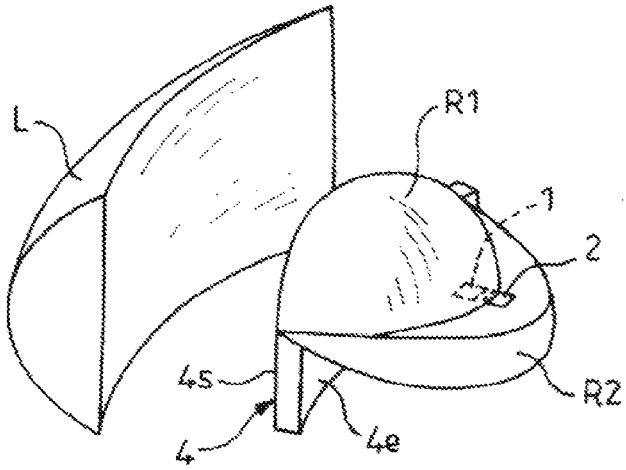
FIG. 10 is a three-quarter rear and from above view in perspective of a module similar to that of FIG. 1, but also fitted with a strip for preventing the interference light originating from the emitter.
Figure 11:
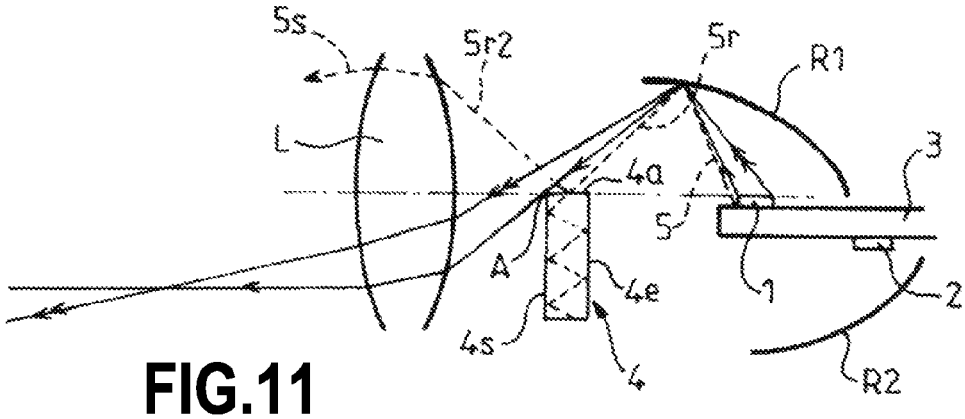
FIG. 11 is a diagram in vertical section illustrating the module of FIG. 10.

FIGS. 10 and 11 show a module of the same type as that of FIGS. 1-3 and which corresponds to the case in which the first emitter 1 radiates upward and creates a beam situated beneath its horizontal cutoff line (FIGS. 1-4).

Certain LEDs may have zones of low brightness in the vicinity of the edges of their emitters 1. If an LED of this type is employed to produce the first emitter 1, interference rays appear above the cutoff, interference rays which, depending on the function produced (and notably the horizontal spread of the beam) may reduce to a greater or a lesser degree the quality of the beam (these interference rays correspond potentially to dazzling).

If the LED cannot be changed for a more suitable model, it is possible to add to the system a strip of transparent material 4 (FIG. 11) having a flat upper face 4*a* contained in the plane of the first emitter 1 and a front face consisting of a fraction of a cylinder with vertical generatrices accepting the control curve A for a cross section. The rear face, situated closer to the emitter 1 than the front face, can be the result of a translation of the front face or a parallel surface.

The upper front edge of the strip 4 is indistinguishable from the control curve A and therefore passes through the focal point of the lens L in a vertical sectional plane. The entrance face 4*e* of the strip 4 is convex toward the front and the exit face 4*s* is parallel to the face 4*e*, the thickness of the strip being constant.

In the absence of interference rays, no ray emitted by the first emitter 1 and reflected by the associated reflector R1 reaches this strip 4.

On the other hand, the interference rays such as 5, shown in dashed lines, reach the upper face 4*a* of the strip and undergo both a partial reflection and a refraction. The ray 5*r*, reflected by the reflector R1 from the ray 5, falls on the upper face 4*a* of the strip 4 behind the front edge and therefore behind the focal point of the lens for the plane in question. The portion 5*r*2 reflected by the face 4*a* reaches the lens L and is returned along the ray 5*s* in the beam, beneath the cutoff because of the "folding" phenomenon. If the refractive index of the material of the strip 4 is greater than $\sqrt{2}$, the refracted portion is guided towards the bottom of the strip 4 where a means is provided for it to be absorbed.

Such a device therefore ensures the absence of interference rays above the cutoff. The fraction of energy lost by guidance is negligible. For example, 0.58 Im for an LED at 600 Im—with 380 Im in the beam behind the lens, in one of the exemplary embodiments.

In this variant, a large portion of the rays reflected on the second reflector R2 associated with a second emitter 2 meets the transparent strip 4. It is then preferable, during the design of the second reflector R2, to take account of the diversions (or, as is equivalent, of the modification of the optical path) introduced by this strip 4. In this design, no notice is taken of the upper face of the guide and its front face is considered to be an infinite vertical extent; moreover, a single source point that the construction rays must meet is considered, situated at the center of the second emitter 2.

The second reflector R2 is determined such that, along a reverse path of the light, the light rays r3, r4 parallel to an arbitrary direction, chosen in a plane parallel to the parallel planes of the emitters 1, 2, after passing through and diversion by the lens L, after passing through the rear face then the front face of the strip, and reflection of the second reflector R2, meet the second emitter 2 at a point of its center, the front face being considered to be an infinite vertical extent and considering a given thickness of strip 4.

The upper face 4*a* of the guide 4 then acts as a folding element in total reflection and creates a partial bottom cutoff in the concentrated beam. The thicker the guide 4, the fewer rays pass over the guide, therefore the less light passes beneath this partial bottom cutoff, but the less extended is the second reflector R2, since it is physically limited by the rear face of the guide 4.

Variant

It is possible to obtain a variant with the two reflectors R1, R2 with no transparent strip, where the second reflector R2 is constructed by means of designs carried out for the enhancement 2, applied in the case of a guide 4 of zero thickness. The second reflector R2 and the second emitter 2 thus give an intense beam with no cutoff which can be used for a function of the high beam type and which has a great overlap with the cutoff beam created by the first emitter 1. Although this variant causes a transmission of additional light rays without the cutoff, it has the advantage of making it possible to obtain a beam that is much more intense than the beam with image alignment. Moreover, it is possible to limit this quantity of rays transmitted beneath the cutoff by the second reflector R2 by shifting the second emitter 2 rearward.

This variant is compatible with the enhancement 1 above. The second reflector R2, the emitter 2 and the lens L form a variant lighting unit according to the invention.

Figure 12:
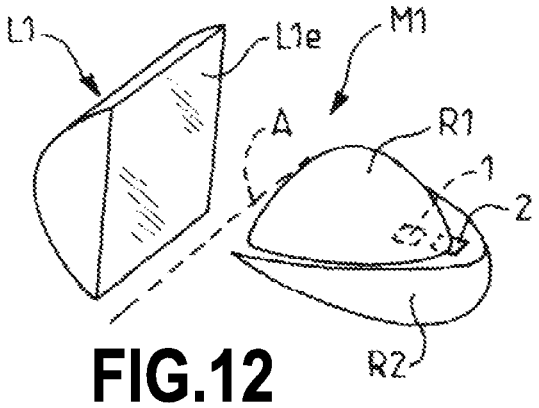
FIG. 12 is a view in perspective, similar to FIG. 1, of a module according to the invention with rectilinear control curve.

FIG. 12 shows in perspective, in a manner similar to FIG. 1, a module M1 according to the invention in which the control curve A is horizontally rectilinear so that the lens L1 has an entrance face L1*e* which is flat, vertical. The second reflector R2, the emitter 2 and the lens L1 form a variant lighting unit according to the invention.

Figure 13:
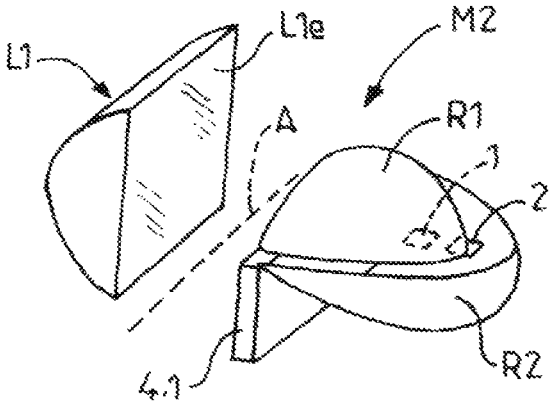
FIG. 13 is also a diagram in perspective of a module with a rectilinear control curve, also fitted with a strip for preventing the interference light originating from the emitter.

FIG. 13 shows, like FIG. 12, a module M2 with control curve consisting of a straight line, and also fitted with a strip 4.1 with parallel vertical flat faces suitable for preventing the interference rays due to the rays originating from the edges of the flat emitter 1. The second reflector R2, the emitter 2 and the lens L1 form a variant lighting unit according to the invention.

Figure 14:
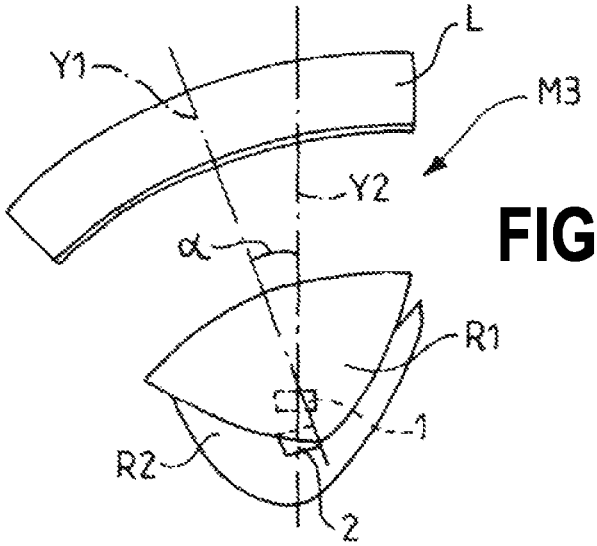
FIG. 14 is a view from above of a module according to the invention with the beam of the second emitter offset laterally relative to the dim beam.

With reference to FIG. 14, a module M3 with beam offset laterally can be seen in plan view. The cutoff beam produced by the reflector R1 has an optical axis Y1 that differs from the optical axis Y2 of the beam produced by the reflector R2 for the high beam. The angle $\alpha$ of lateral offset of the high beam of axis Y2 relative to the axis Y1 of the cutoff beam can be 14°. The whole module M3 is turned by the same value, in the opposite direction, so that the optical axis Y2 is parallel to the axis of the vehicle. The second emitter 2 is offset laterally in the direction opposite to the offset of the beam, for example −10 mm in the transverse direction of the vehicle, before rotation of the module in order to optimize the performance of the high beam. The second reflector R2, the emitter 2 and the lens L form a variant lighting unit according to the invention.

Figure 15:
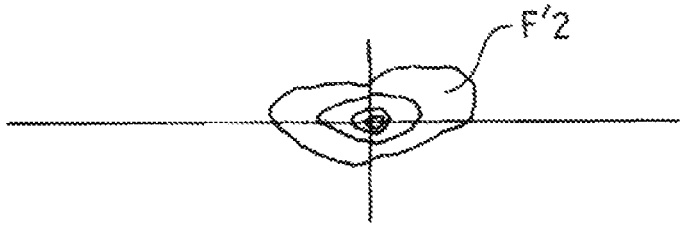
FIG. 15 is a diagram of the isolux curves produced by the second emitter with the second reflector of FIG. 14.

FIG. 15 is a diagram of the isolux curves of the beam F'2 obtained with the second emitter 2 of FIG. 14, a beam that is situated on either side of the horizontal cutoff line.

Figure 16:
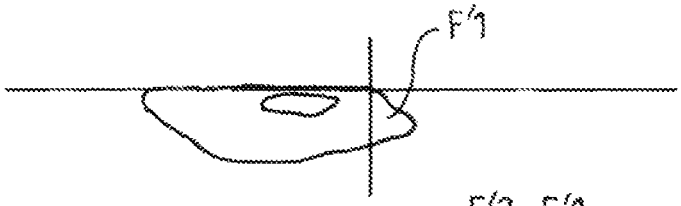
FIG. 16 is a diagram of the isolux curves given by the dim beam of FIG. 14.

FIG. 16 illustrates the isolux curves of the beam F'1 obtained with the first emitter 1 of FIG. 14, a beam that is offset laterally relative to the beam of FIG. 15.

Figure 17:
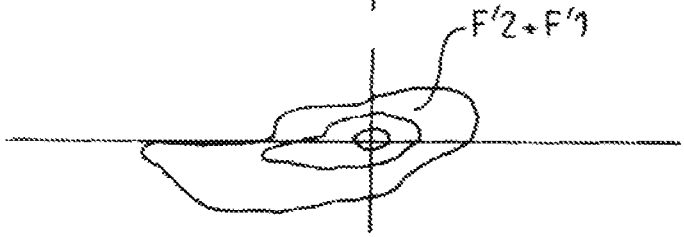
FIG. 17 is a diagram of the isolux curves obtained by merging of the beams of FIGS. 15 and 16.

FIG. 17 illustrates the isolux curves of the beam resulting from the merging of the beam F'1 of great width for the dim beam and of the high beam F'2 addition.

In order to improve the beam obtained by merging the two elementary beams, the "high" additional beam F'2 should be placed with its maximum situated 1% higher than the cutoff line.

Figure 18:
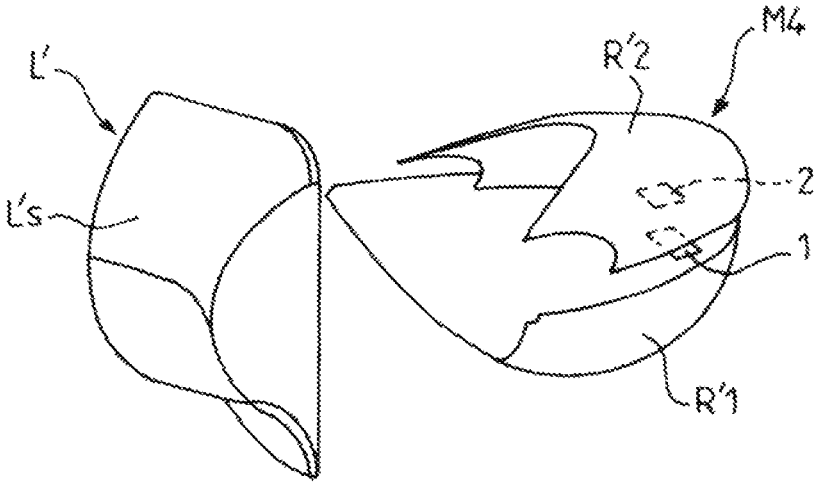
FIG. 18 is a schematic view in perspective, from the front and the side of a module with concave lens.
Figure 19:
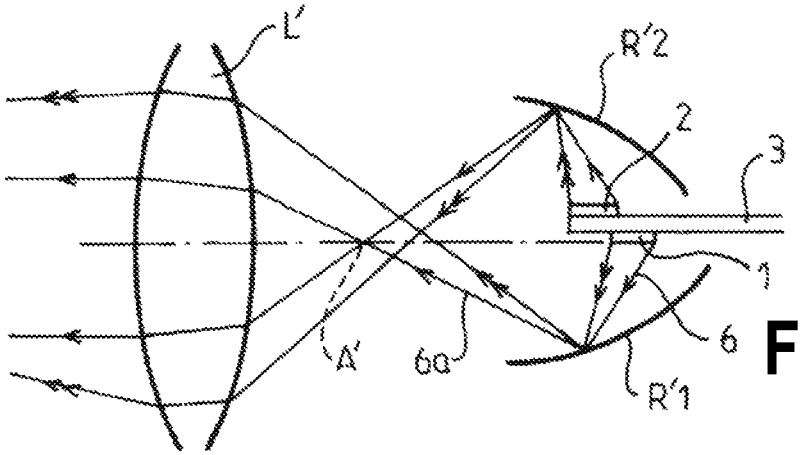
FIG. 19 is a diagram of the bifunction module of FIG. 18 according to which the dim emitter emits downward while the additional emitter for the high beam emits upward.

With reference to FIGS. 18 and 19, a module M4 according to the invention can be seen in which the LED 1 for the cutoff beam emits downward and the first associated reflector R'1 is situated beneath the LED 1. The LED 2, for the high beam, emits upward and the second associated reflector R'2 is situated above this emitter 2. The second reflector R'2, the emitter 2 and the lens L form a variant lighting unit according to the invention.

Figure 20:
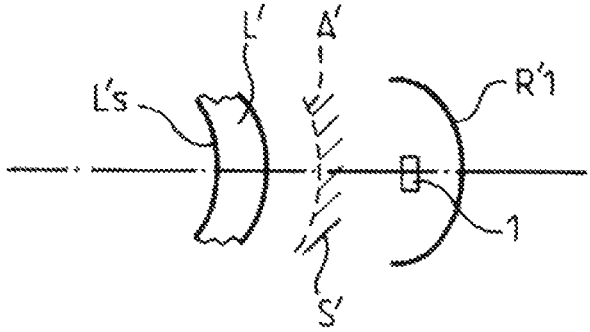
FIG. 20 is a diagram in horizontal section of the module of FIG. 19, with concave control curve oriented forward.

The control curve A' (FIG. 20) is concave in the direction of the lens L'. The exit face L's of this lens is also concave as can be seen in FIG. 18.

The reflector R'1 is determined so as to create a hot spot S' (FIG. 20) situated behind the control curve A' and accepting this curve as a front limit. The rays such as 6 originating from the rear edge of the first emitter 1 are reflected at 6*a* by the reflector R'1 so as to rest on the curve A' which corresponds to the focal point of the stigmatic lens in a vertical sectional plane, in a similar manner to what has been explained with reference to FIG. 3.

In these conditions, the rays originating from points situated in front of the rear edge of the emitter 1, after passing through the lens L', will be inclined downward on the horizontal plane. The beam produced by the first emitter 1 and the first reflector R'1 will be a cutoff beam situated beneath the cutoff line.

The rear edge of the second emitter 2 emits rays which, after reflection by the second reflector R'2, rest on the curve A' or are situated behind this curve. The other points of the second emitter 2 will give rays which, after passing through the lens L', will be directed upward relative to the horizontal.

Figure 21:
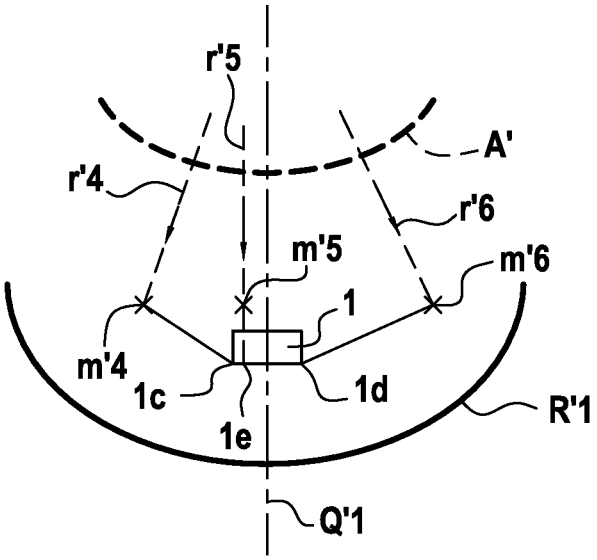
FIG. 21 is a diagram illustrating the design of the reflector in the case of a concave control curve according to FIG. 19.

If the lens L' is concave, as illustrated in FIG. 18, with the dim emitter 1 emitting downward, the first reflector R'1 is determined as illustrated in FIG. 21 so that the light rays r'4, r'6 in question along the reverse path of the light converge on the rear corners 1*c*, 1*d* of the flat rectangular emitter 1, on the same side of the vertical plane Q'1 passing through the optical axis as their point of intersection m'4, m'6 with the reflector R'1, if m'4, m'6 is outside the space included between two planes Q2 and Q3 parallel to Q'1 and passing through the rear corners of the emitter 1.

Figure 22:
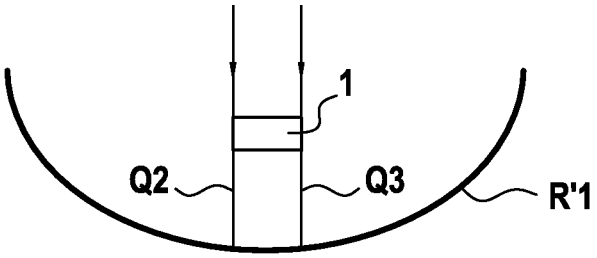
FIG. 22 is an additional diagram of the design of the reflector of FIG. 21.

When the intersection m'5 of a ray r'5, considered along the reverse path of the light, with the reflector R'1 is situated between the planes Q2 and Q3 of FIG. 22, it reaches the point 1*e* of the rear edge of the emitter situated in the plane parallel to Q'1 containing m'5.

In order to determine a point of the reflector, the equation describing the constancy of the optical path (according to the Fermat theorem) from the curve A' to the corresponding source point of the emitter is solved for three possible cases of hypothetical source points:

the two ends of the rear segment of the emitter; and the point of the straight line supporting this segment of same projection on this straight line as the point of the reflector sought.

Only one of the three solutions found then complies with the conditions posed above (relative to the rays r'4 and r'5).

Other variants with cutoff beams situated above the cutoff line are possible.

In the case of FIGS. 1-3, so that the first emitter 1 gives a cutoff beam situated above the cutoff line, the first reflector R1 is determined so that it gives a hot spot situated behind the control curve A, instead of being in front in the example that has been described.

In the case of FIGS. 18 and 19, in order to obtain a cutoff beam situated above the cutoff, the first reflector R'1 is determined so that it gives a hot spot situated in front of the concave control curve A'.

Whichever solution is adopted, a cutoff beam is obtained by controlling only the lighting of the first emitter 1, and a high beam by controlling the lighting of the two emitters 1 and 2. The merging of two beams is then carried out in good conditions, without the presence of a dark band between them since there is no material folding element edge. This merging is carried out without it being necessary to control a mechanical movement of a folding element.

The invention makes it possible to have a module with a toroidal rather than an elliptical lens. It is therefore possible to assemble several similar modules with toroidal lenses, in continuity of tangency of the surfaces of the lenses.

The module produces a broad beam with clean cutoff and comprises no complex folding element shape in order to compensate, always partially, for the aberrations of the lens.

There is no risk of a focusing of solar rays on the surface of the reflector or of the LEDs causing damage to these elements. Specifically, the lens is nonimaging, that is to say that it forms no image of an object situated at its focal point in any real or virtual plane, including when the size of the object tends toward 0. Good performance is obtained for the high beam and for the dim beam relative to the more conventional solutions with a folding element. There are no difficult parts to be produced.

According to the present invention, it is possible to use a first lighting module according to the invention with a lighting unit according to the invention, the module and the unit being two distinct sets of optical systems, with a distinct lens. This use can be achieved in one and the same vehicle headlamp, the lighting unit and the lighting module being placed in the housing of the headlamp. The housing is preferably closed, preferably by a transparent closing glass.

Figure 23:
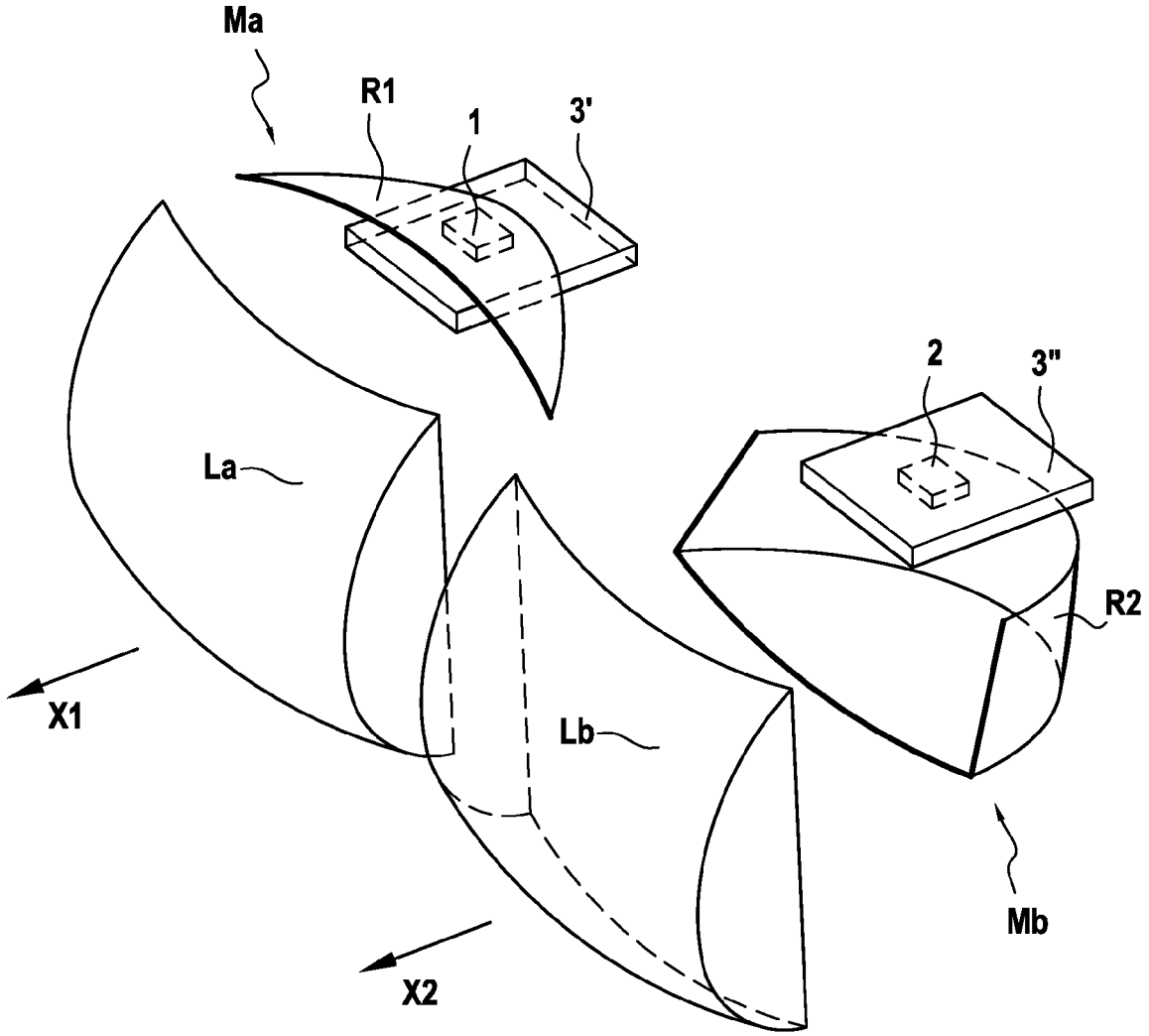
FIG. 23 is a particular embodiment according to the invention seen in perspective.
Figure 24:
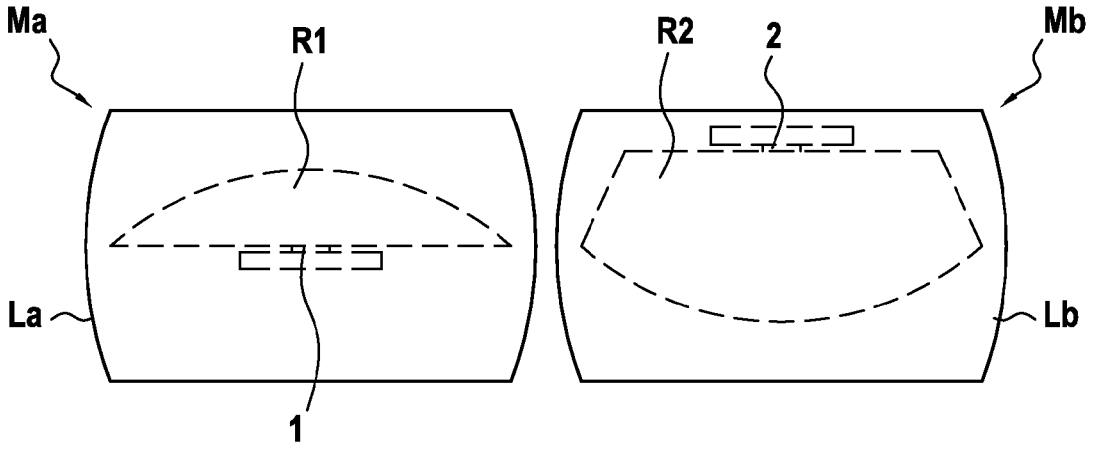
FIG. 24 is a front view of the embodiment of FIG. 23.
Figure 25:
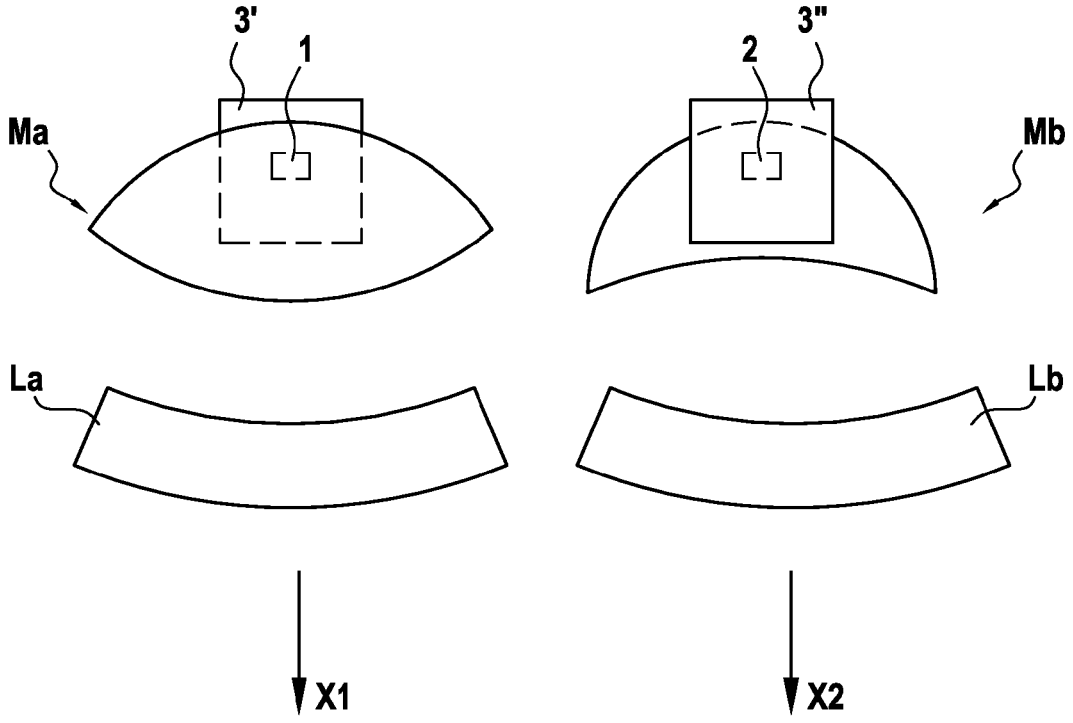
FIG. 25 is a view from above of the embodiment of FIG. 23.

For example, FIGS. 23 to 25 illustrate the lateral juxtaposition of a first lighting module Ma with a lighting unit Mb, each having its own lens, respectively La and Lb.

The first lighting module Ma may be a lighting module according to the invention. In the example illustrated in FIGS. 23 to 25, the latter corresponds to a module like that illustrated in FIG. 1, but without the reflector R2, or the emitter 2. The module Ma comprises a first reflector R1, diverting the rays emitted by an LED 1 to the lens La, in order to create a first beam in a general direction X1.

The first reflector R1 and the lens La have a determined shape and are arranged like the first reflectors and the lenses of the lighting modules according to the present invention as described above. Other lighting modules according to the invention could therefore be used, with or without a lighting unit according to the invention, such as, for example, a module like that of FIG. 4, with or without the second reflector R2 and the second emitter 2.

The lighting unit Mb may be a lighting unit according to the invention. In the example illustrated in FIGS. 23 to 25, the latter corresponds to a lighting unit like that illustrated in FIG. 1, without a first reflector R1 or a first emitter 1. The lighting unit Mb comprises a second reflector R2 diverting the rays emitted by an LED 2 toward the lens Lb, in order to create a second beam in a general direction X2.

The second reflector R2 and the lens Lb have a determined shape and are arranged like the second reflectors and the lenses of the lighting modules according to the present invention described above. Other lighting units according to the invention could therefore be used.

Alternatively, the lighting module may be a module like the module M4 illustrated in FIG. 18, without the second reflector and without the second emitter. The lighting unit may then be a unit like the unit R'2, 2, L', illustrated in FIG. 18, without the first reflector and without the first emitter.

In FIGS. 23 to 25, the lighting module Ma and the lighting unit Mb are aligned transversely, but they could also be superposed. The lenses La and Lb may be side by side with little space between them, as illustrated. They may also be adjacent; since the lenses are similar, or even identical, in shape, it is then possible to have a more uniform appearance, or even to place them in the continuity of one another transversely, in order to give an impression of a single lens.

In the example illustrated in FIGS. 23 to 25, in a nonlimiting manner, the first emitter 1 and the second emitter 2 are mounted on distinct supports 3' and 3". The first cutoff beam and the second beam may be beams as described above and be combined as described above. The arrangement of the first reflector R1 relative to the second reflector R2 and/or the offset between the first emitter 1 and the second emitter 2 may be as described above.

The invention also covers vehicle headlamps using lighting modules according to the invention but with no lighting unit according to the invention, for example a module such as the lighting module Ma described above and illustrated, in a nonlimiting manner, in FIGS. 23 to 25. This module may, for example, be used to produce a second cutoff beam. It is then possible to have a second module, for example already known, in order to produce an additional high beam, either in addition, or as an alternative to the lighting of the first module.

Similarly, the invention also covers vehicle headlamps using lighting units according to the invention but with no first reflector, for example a unit such as the lighting module Mb described above and illustrated, in a nonlimiting manner, in FIGS. 23 to 25. This module may, for example, be used to produce a high beam. It is then possible to have a lighting module, for example already known, in order to generate a cutoff beam, the lighting unit being lit either in addition or as an alternative to the lighting of the module.

The invention also covers a lighting unit M5, as illustrated in FIG. 26 to FIG. 29. This lighting unit is a lighting unit according to the present invention. For example, this unit is similar to the lighting module Mb previously described and illustrated, in a nonlimiting manner, in FIGS. 23 to 25. However, this lighting unit M5 is designed to be mounted in the headlamp while being turned through 90° along a longitudinal axis relative to the mounting of the lighting unit Mb of FIGS. 23 to 25.

Thus, the lighting unit M5 is intended to be arranged in the headlamp of a motor vehicle, suitable for providing a light beam, such that:

- the emitter 2 is arranged to emit a beam of light rays generally in a transverse direction;
- the reflector R"2 is arranged to collect all of this beam of rays;
- the orthogonal plane Vc is orthogonal to a vertical plane, preferably containing the longitudinal direction.

Figure 26:
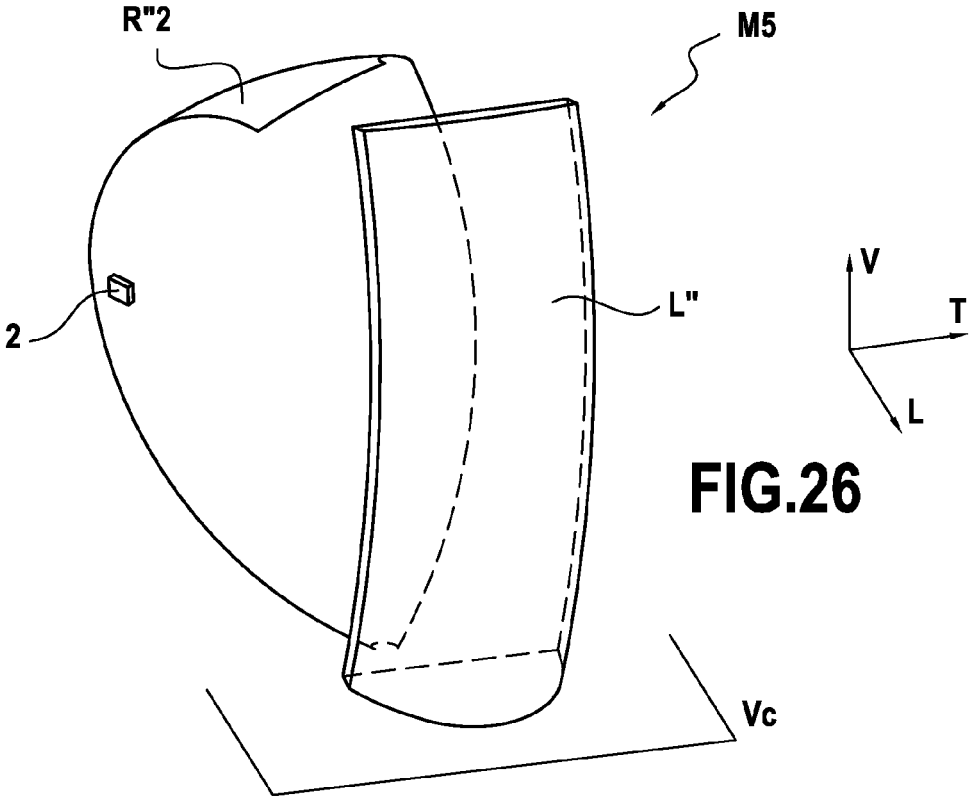
FIG. 26 is a schematic view in perspective, from the front and the side of a lighting unit according to the invention, with a lens extending vertically.
Figure 27:
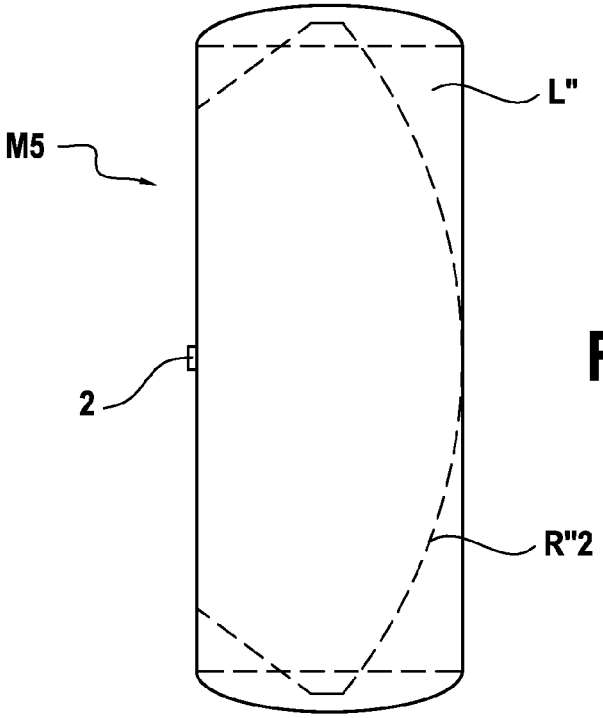
FIG. 27 is a front view of the lighting unit according to FIG. 26.
Figure 28:
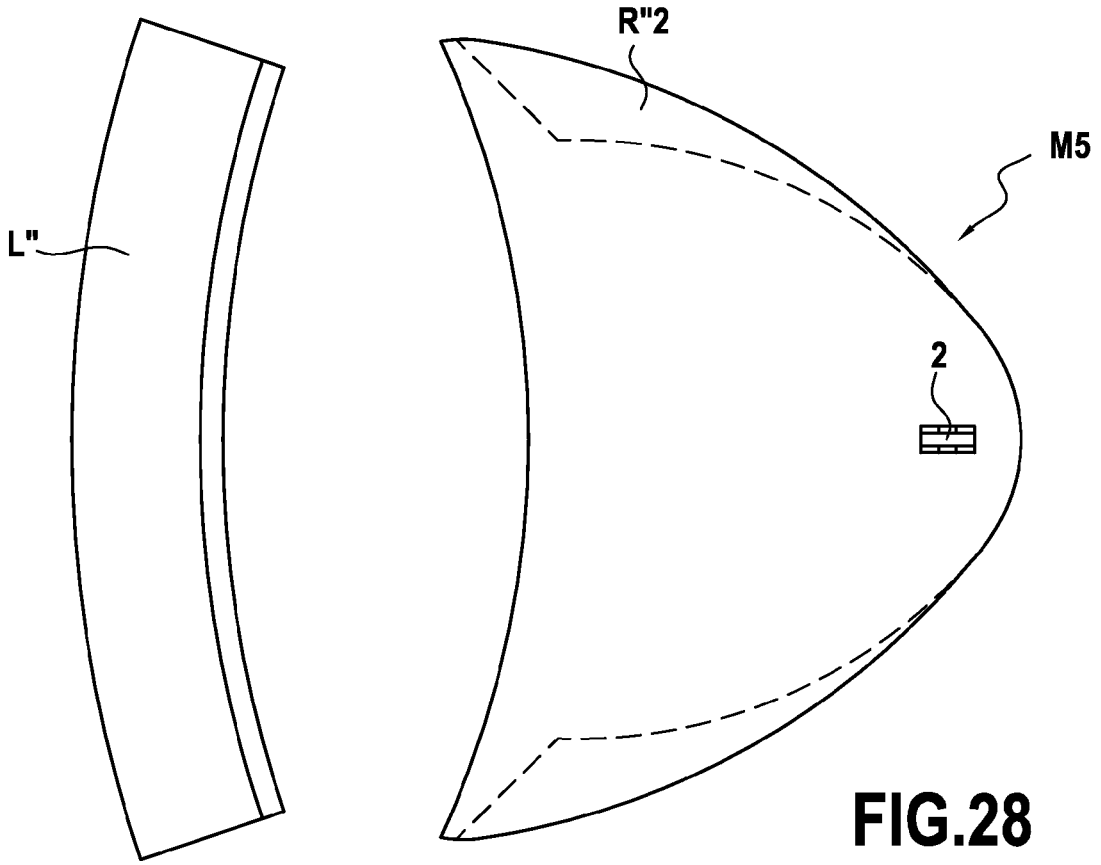
FIG. 28 is a side view of the lighting unit according to FIG. 26.

In FIG. 26, a rectangular coordinate system has been positioned to show schematically the vertical "V", a transverse direction "T" and a longitudinal direction "L".

It can be seen therefore that the planes along which the section of lens L" is stigmatic, as described above, are always orthogonal to a vertical plane. In other words, the lens L" extends vertically in its longest direction. In the case of a toroidal lens, the guiding curve is therefore vertical.

According to a variant embodiment, this lighting unit M5 is made so as to generate a beam with a cutoff, as previously described for the formation of the additional high beam. This makes it possible to have a vertical cutoff beam when it is placed in the headlamp, since the lighting unit is turned through 90° compared with the units described in the other embodiments.

Figure 29:
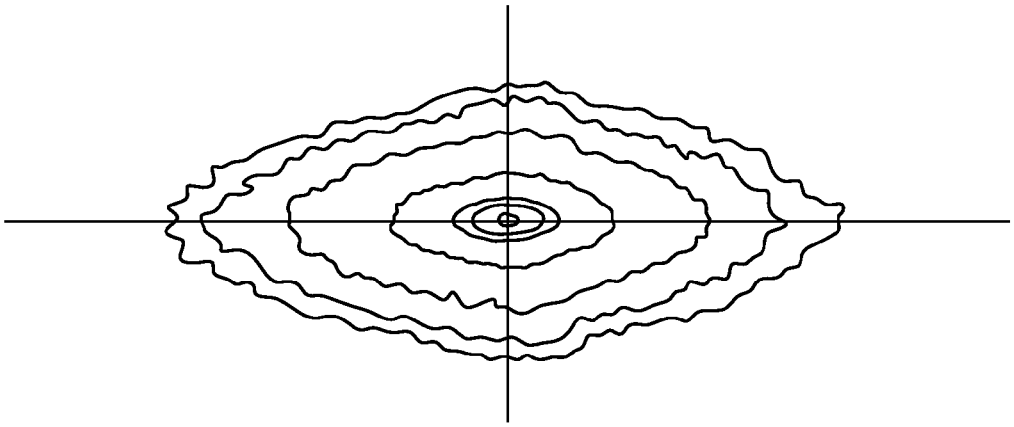
FIG. 29 is a light beam produced by the lighting unit illustrated in FIG. 26.

According to another variant embodiment, this lighting unit M5 is made so as to be capable of generating a beam without cutoff, as previously described, while placing the lens vertically. Surprisingly, the lens makes it possible to generate a high beam as illustrated in FIG. 29 while the lens L" extends vertically. The reflector R"2 extends on either side of the horizontal plane passing through the LED 2. The reflector R"2 forms a concavity oriented transversely to the vehicle, for example the reflector R"2 is formed of a half shell situated approximately wholly on one side of the vertical and longitudinal plane passing through the LED 2.

The advantage of this lighting unit M5 is that it allows an installation in a headlamp with a low transverse bulk. It also makes it possible to follow a curve in a vertical plane and to thus produce two high beams with a strong return on the top of the vehicle wing. It also allows a different orientation for reasons of style.

While the system, apparatus and method herein described constitute preferred embodiments of this invention, it is to be understood that the invention is not limited to this precise system, apparatus and method, and that changes may be made therein without departing from the scope of the invention which is defined in the appended claims.

What is claimed is:

1. A lighting module for a headlamp of a motor vehicle, suitable for providing a first cutoff beam, said lighting module comprising:

a first flat light emitter in order to give a first beam;

a lens (L,L1,L',La) placed in front of said first flat light emitter;

a first reflector (R1,R'1);

wherein:

said first reflector (R1,R'1) is determined so as to create, in a plane comprising said first flat light emitter, a hot spot (S,S') by diversion of the rays emitted by said first flat light emitter, said hot spot being limited by a control curve (A,A') forming a front edge or a rear edge of said hot spot (S,S'), said control curve (A,A') being contained in a plane comprising said first flat light emitter and situated in front of said first flat light emitter;

wherein a section (Lc) of said lens (L,L1,L',La) through a plane (Vc) orthogonal to said control curve causes light rays (r1) reflected by said first reflector (R1,R'1) and passing through an intersection (ac) at an intersection of said (Vc) and said control curve (A,A') to pass through said lens (L,L1,L',La) and exit said lens (L,L1,L',La) parrallel to an optical axis of said lighting module, said first reflector (R1,R'1) and said lens alone being arranged so as to form a first cutoff beam after refraction by said lens (L,L1,L',La) of said light rays (r1) diverted by said first reflector (R1,R'1).

2. The lighting module as claimed in claim 1, wherein said first reflector (R1, R'1) causes images (I1,I2) of said first flat light emitter, that it provides in the plane of this emitter, to meet said control curve (A, A'), while being entirely on the side of said hot spot (S,S').

3. A lighting unit for a headlamp of a motor vehicle, suitable for providing a light beam, said lighting unit comprising:

a flat light emitter in order to give a first beam;

a lens (L,L1,L',Lb) placed in front of said flat light emitter;

a reflector (R2,R'2) in order to divert the rays emitted by said flat light emitter, wherein:

a reflective surface of said reflector (R2, R'2) wherein along a reverse path of the light, the light rays (r3, r4) parallel to a given direction, after passing through and diversion by said lens (L,Lb) and reflection on said reflector (R2, R'2), meet said flat light emitter at a given point of said flat light emitter;

wherein a section (Lc) of said lens (L,L1,L',Lb) through a plane (Vc) orthogonal to a control curve (A, A'), causes light rays (r1) reflected by said reflector (R2,R'2) and passing through an intersection (ac) at an intersection of said plane (Vc) and said control curve (A,A') to pass through said lens (L,L1,L',Lb) and exit said lens (L,L1, L',Lb) parallel to an optical axis of the lighting unit, said control curve (A, A') being situated in front of said flat light emitter, said reflector (R2,R'2) and lens alone being arranged so as to form said light beam, after refraction by said lens (L,L1,L',Lb) of said light rays (r1) diverted by said reflector (R2,R'2).

4. The lighting unit as claimed in claim 3, wherein said given point of said flat light emitter is a point of the front or rear edge of said flat light emitter.

5. The lighting unit as claimed in claim 3, wherein said reflector (R2) comprises a shape that is defined by:

a transparent strip (4) having a front face (4*s*) indistinguishable from its rear face and being a fraction of a cylinder with generatrices orthogonal to a plane of said control curve (A), said front face having a vertical portion so that, along a reverse path of the light, light rays (r3, r4) that enter a rear face of said lens (L,L1,L',Lb) parallel to said optical axis, pass through said lens, through said front face of said transparent strip (4), through a rear face of said transparent strip (4), and reflect on said reflector (R2), meet said flat light emitter at a point in the vicinity of a center of said light emitter.

6. The lighting unit (M5) as claimed in claim 3, wherein the lighting unit is arranged in a headlamp of a motor vehicle, suitable for providing a light beam wherein:

said flat light emitter is arranged so as to emit a beam of light rays generally in a transverse direction;

said reflector (R"2) is arranged to collect all of this beam of rays;

said orthogonal plane (Vc) is orthogonal to a vertical plane.

7. The lighting module as claimed in claim 1, wherein said lighting module also comprises a lighting unit, a second emitter, a reflector of said lighting unit corresponding to a second reflector (R2, R'2) of said lighting module, said first reflector (R1, R'1) and said lens (L,L1,L') being arranged so as to form a first cutoff beam, said second reflector (R2, R'2) and said lens (L,L1,L') being arranged so as to form a second light beam.

8. The lighting module as claimed in claim 7, wherein a reflective surface of said second reflector (R2, R'2) cooperates with said first reflector (R1,R'1) to cause said second light beam to be added to said first cutoff beam in order to produce a high beam.

9. The lighting module as claimed in claim 7, wherein either said second emitter emits upward and said first emitter emits downward, or said second emitter emits downward and said first emitter emits upward.

10. The lighting module as claimed in claim 7, wherein said second emitter is offset transversely relative to said first emitter, so that said first cutoff beam produced by said first reflector (R1) has an optical axis (Y1) that is different from an optical axis (Y2) of said second light beam produced by said second reflector (R2).

11. The lighting module as claimed in claim 7, wherein said lighting unit is arranged in a headlamp of a motor vehicle, suitable for providing a light beam wherein:

said second emitter (2) is arranged so as to emit a beam of light rays generally in a transverse direction;

said reflector (R"2) is arranged to collect all of said light rays;

said orthogonal plane (Vc) is orthogonal to a vertical plane.

12. The lighting module as claimed in claim 1, wherein said hot spot (S) is in front of said control curve (A), which said control curve (A) is convex seen from said lens, or rectilinear.

13. The lighting module as claimed in claim 1, wherein for any point (p, pb) of a reflective surface of said first reflector (R1,R'1), a ray (r, rb) meeting said control curve (A) and reflected by said first reflector (R1) at said point (p, pb) arrives, after reflection, at a front corner (1*a*, 1*b*) of said first flat light emitter, situated on the side opposite to said point (p, pb), relative to a vertical plane (Q1) passing through said optical axis.

14. The lighting module as claimed in claim 1, wherein said first flat light emitter emits upward, and creates with said first reflector (R1) a first cutoff beam of which said hot spot (S,S') is situated beneath its cutoff line, and said lighting module comprises a strip made of transparent material having a top flat face (4*a*) contained in said plane of said first flat light emitter, and a front face (4*s*) consisting of a fraction of a cylinder with generatrices orthogonal to said plane of said control curve (A), accepting said control curve as a cross section, so that a refracted portion of the rays (5*r*) reaching said top flat face enter said strip.

15. The lighting module as claimed in claim 7, wherein said first emitter emits upward, and creates with said first reflector (R1), a first cutoff beam of which said hot spot (S,S') is situated beneath its cutoff line, and said lighting module comprises a transparent strip (4) made of transparent material having a top flat face (4*a*) contained in said plane of said first emitter, and a front face (4*s*)consisting of a fraction of a cylinder with generatrices orthogonal to said plane of said control curve (A), accepting this control curve as a cross section, so that a refracted portion of the rays (5*r*) reaching said top flat face enter said strip; and wherein said second reflector (R2), along a reverse path of the light, light rays (r3, r4) that enter said lens parallel to said optical axis and pass through said lens (L,L1,L'), through said front face (4*s*) of said transparent strip (4), a rear face (4*e*) of said transparent strip (4), and reflection on said second reflector (R2), meet said second emitter at a point of a center of said second emitter, said front and rear faces being vertical with respect to said optical axis.

16. The lighting module as claimed in claim 1, wherein said hot spot (S') in said plane of said first flat light emitter is behind said control curve (A') which is concave seen from said lens, or rectilinear.

17. The lighting module as claimed in claim 1, wherein for any point (m'4, m'6) on a first portion of reflective surface of said first reflector (R'1) that is situated outside the space included between two planes (Q2 and Q3) passing through rear corners (1*c*, 1*d*) of said first flat light emitter and parallel to a vertical plane (Q'1) passing through said optical axis, a ray (r'4, r'6) meeting on said control curve (A') and reflected by said first reflector (R'1) at this point (m'4, m'6) arrives, after reflection, at said rear corner (1*c*, 1*d*) of said first flat light emitter, situated on the same side as a given point (m'4, m'6) relative to said vertical plane (Q'1) passing through said optical axis.

18. The lighting module as claimed in claim 17, wherein for any given point (m'5) on a second portion of reflective surface of said first reflector (R'1) that is situated inside the space included between two planes (Q2 and Q3) passing through said rear corners (1*c*, 1*d*) of said first flat light emitter and parallel to said vertical plane (Q'1) passing through said optical axis, a ray (r'5) passing through said control curve (A') and reflected at this given point (m'5) of said second portion of reflective surface, arrives, after reflection, at a point (1*e*) of a rear edge of said first flat light emitter situated in said plane which contains said given point (m'5) of said second portion of reflective surface and is parallel to said vertical plane (Q'1) passing through said optical axis.

19. A headlamp of a motor vehicle, comprising at least one lighting module and/or one lighting unit as claimed in claim 1.

20. The lighting module as claimed in claim 7, wherein said lighting unit comprises:

a flat light emitter in order to give a first beam;

a lens (L,L1,L',Lb) placed in front of said flat light emitter;

a reflector (R2,R'2) in order to divert the rays emitted by said flat light emitter, wherein:

a reflective surface of said reflector (R2, R'2), wherein along a reverse path of the light, the light rays (r3, r4) parallel to a given direction, after passing through and diversion by said lens (L,Lb) and reflection on said reflector (R2, R'2), meet said flat light emitter at a given point of said flat light emitter;

wherein a section (Lc) of said lens (L,L1,L',Lb), through a plane (Vc) orthogonal to a control curve (A, A') causes light rays (r1) reflected by said first reflector (R2,R'2) and passing through an intersection (ac) at an intersection of said plane (Vc) and said control curve (A,A') to pass through said lens (L,L1,L', Lb) and exit said lens (L,L1,L',Lb) parallel to an optical axis of said lighting module, said control curve (A, A') being situated in front of said flat light emitter, said reflector (R2,R'2) and said lens (L,L1,L',Lb) being arranged so as to form said light beam, after refraction by said lens (L,L1,L',Lb) of said light rays (r1) diverted by said reflector (R2,R'2).

21. A lighting module for a vehicle, comprising:

a) a horizontal plane (H1) defined within said lighting module, having a forward direction defined therein;

b) an optical axis (Q1) lying in said horizontal plane (H1) running in the forward direction;

c) a light source (1), which lies in or atop said horizontal plane (H1) and intersects said optical axis (Q1);

d) a toroidal lens (L), located forward of said light source (1) and through which said optical axis (Q1) runs and having i) a rear entrance face (Le) which faces toward said light source;

ii) said rear entrance face (Le) having a first associated curve (B) which runs along said rear entrance face (Le) and intersects said horizontal plane (H1);

iii) said rear entrance face (Le) further having a control curve (A,A'), which is displaced from said rear entrance face (Le) toward said light source (1) and which lies in the horizontal plane (H1) and lies a constant distance (D) from said rear entrance face (Le), said constant distance (D) being a back focal distance of said toroidal lens (L); and e) a first reflector (R1,R'1) is determined so as to create, in a plane comprising a first flat light emitter, a hot spot (S,S') by diversion of the rays emitted by said first flat light emitter, said hot spot being limited by said control curve (A,A') forming a front edge or a rear edge of said hot spot (S,S') and by said first associated curve (B), said control curve (A,A') being contained in a plane comprising said first flat light emitter and situated in front of said first flat light emitter;

f) wherein a section (Lc) of said lens (L,L1,L', La), through a plane (Vc) orthogonal to said control curve causes light rays (r1) reflected by said first reflector (R1,R'1) and passing though an intersection (ac) at an intersection of said plane (Vc) and said control curve (A,A') to pass through said lens (L,L1,L', La) and exit said lens (L,L1, L', La) parallel to an optical axis of said lighting module, said first reflector (R1,R'1) and said lens alone being arranged so as to form a first cutoff beam after refraction by said lens (L,L1,L',La) of said light rays (r1) diverted by said first reflector (R1,R'1).

22. The lighting module according to claim 21, wherein no light passing through said hot spot region (S) exits said toroidal lens (L) above said horizontal plane (H1).

23. The lighting module according to claim 21, wherein said lighting module creates a cutoff beam without the aid of a horizontal or vertical mask.

24. The lighting module according to claim 21, wherein a given point of said light source (1) is a point of the front or rear edge of said light source (1).

25. The lighting module according to claim 21, wherein said lighting module is adapted to be arranged in a headlamp of a motor vehicle for providing a light beam, wherein:

said light source (1) is arranged so as to emit a beam of light rays generally in a transverse direction;

said first reflector (R1) is arranged to collect all of said beam of light rays;

an orthogonal plane (Vc) is orthogonal to at least one of said first associated curve or said second associated curve and to a vertical plane.

26. The lighting module according to claim 21, wherein said light source (1) is an emitter that is flat.

27. The lighting module according to claim 21, wherein:

said light source (1) is arranged so as to emit a beam of light rays generally in a transverse direction;

said first reflector (R1) is arranged to collect all of said beam of light rays;

an orthogonal plane (Vc) is orthogonal to at least one of said first associated curve or said second associated curve is and to a vertical plane.

28. The lighting module as claimed in claim 21, wherein said lighting module also comprises a lighting unit, said lighting unit comprising a second light source (2) of said lighting module, the reflector of said lighting unit corresponding to a second reflector (R2, R'2) of said lighting module, said first reflector (R1) and said toroidal lens (L) being arranged so as to form a first cutoff beam, said second reflector (R2, R'2) and said toroidal lens (L) being arranged so as to form a second light beam.

29. The lighting module as claimed in claim 28, wherein a reflective surface of said second reflector (R2, R'2) is determined so that said second light beam is added to said first cutoff beam in order to thus produce a high beam.

30. The lighting module as claimed in claim 28, wherein said light source (1) is a first emitter that emits light upward and said second light source comprises a second emitter that emits light downward.

31. The lighting module as claimed in claim 30, wherein said second emitter is offset relative to, said first emitter so that said first cutoff beam produced by said first reflector (R1) has an optical axis (Y1) that is different from an optical axis (Y2) of said light beam produced by said second reflector (R2).

32. The lighting module as claimed in claim 21, wherein said hot spot region (S) is in front of said second associated curve (A), wherein said second associated curve (A) is convex seen from said toroidal lens (L), or rectilinear.

33. The lighting module as claimed in claim 21, wherein said light source (1) emits upward, and creates with said first reflector (R1) a first cutoff beam of which the lit zone is situated beneath its cutoff line, and said lighting module comprises a strip made of transparent material having a top flat face (4*a*) contained in the plane of said light source (1), and a front face (4*s*) consisting of a fraction of a cylinder with generatrices orthogonal to the plane of said second associated curve (A), accepting said second associated curve (A) as a cross section, so that the refracted portion of the rays (5*r*) reaching said top flat face enter said strip.

34. The lighting module as claimed in claim 21, wherein said hot spot region (S) in the plane of said light source (1) is behind said second associated curve (A) which is concave seen from said toroidal lens (L), or rectilinear.

35. The lighting module as claimed in claim 1, wherein said reflector (R1,R'1) is constructed by the process comprising the steps of:

considering that the lighting module comprises a strip of zero thickness, having a transparent strip (4) having a front face (4*s*) indistinguishable from its rear face and being a fraction of a cylinder with generatrices orthogonal to a plane of said control curve (A);

calculating a reflective surface of said reflector (R,R'1) by considering the front face to be an infinite vertical extent;

causing said front face to have a vertical portion so that, along a reverse path of the light, light rays (r3, r4) that enter said lens (L,L1,L',Lb) parallel to said optical axis, pass through said lens, through said front face of said transparent strip (4) , through a rear face of said transparent strip (4), and reflect on said reflector (R2), meet said flat light emitter at a point in the vicinity of a center of said first flat light emitter.

* * * * *